United States Patent [19]

Tapia

[11] Patent Number: 5,070,545

[45] **Date of Patent: * Dec. 10, 1991**

[54] CAP ASSEMBLY

[76] Inventor: Ray Tapia, 1740 W. Kenneth Rd., Glendale, Calif. 91201

[ * ] Notice: The portion of the term of this patent subsequent to Oct. 17, 2006 has been disclaimed.

[21] Appl. No.: 396,081

[22] Filed: Aug. 21, 1989

Related U.S. Application Data

[63] Continuation-in-part of Ser. No. 226,416, Jul. 29, 1988, Pat. No. 4,873,726.

[51] Int. Cl.[5] ..... A42B 1/02

[52] U.S. Cl. ..... 2/195; 2/171.1; 2/10; 2/12

[58] Field of Search ..... 2/10, 12, 171, 171.1, 2/171.2, 171.4, 171.5, 181, 181.2, 181.4, 196, 195, 209.1, 199, DIG. 6

[56] References Cited

U.S. PATENT DOCUMENTS

| | | | |
|---|---|---|---|
| 1,598,313 | 8/1926 | Rosenberg | 2/196 |
| 1,957,356 | 5/1934 | Rosen | 2/181 X |
| 2,651,044 | 9/1953 | Stankiewicz et al. | 2/171 |
| 3,263,235 | 8/1966 | Young | 2/DIG. 6 X |
| 4,023,212 | 5/1977 | Huffman | 2/DIG. 6 X |
| 4,131,953 | 1/1979 | Kimotsuki | 2/171.1 |
| 4,274,157 | 6/1981 | Boden | 2/181.4 |
| 4,611,355 | 9/1986 | Galanto et al. | 2/DIG. 6 X |
| 4,630,317 | 12/1986 | Brown et al. | 2/DIG. 6 X |
| 4,873,726 | 10/1989 | Tapia | 2/195 |

FOREIGN PATENT DOCUMENTS

| | | | |
|---|---|---|---|
| 637556 | 7/1927 | France | 2/10 |

OTHER PUBLICATIONS

Gershman, M., "Self Adhering Nylon Tapes", *Journal of AMA*, vol. 168, No. 7, 1958.

*Primary Examiner*—Werner H. Schroeder
*Assistant Examiner*—Sara M. Current
*Attorney, Agent, or Firm*—James E. Brunton

[57] ABSTRACT

An adjustable baseball type cap assemblage having a crown portion and various interchangeable visor portions. Insignia patches of various styles can be removably affixed to the selected visor and crown portions so that one cap assembly can be modified to identify with two or more athletic teams.

11 Claims, 5 Drawing Sheets

CAP ASSEMBLY

BACKGROUND OF THE INVENTION

1. Field of the Invention

This is a continuation-in-part application of copending application Ser. No. 07/226,416, filed July 29, 1988, now U.S. Pat. No. 4,873,726.

The present invention relates generally to caps. More particularly, the invention concerns an adjustable baseball type cap assemblage having a crown portion and various interchangeable visor portions. Insignia patches of various styles can be removably affixed to the selected visor and crown portions so that one cap assembly can be modified to identify with two or more athletic teams.

2. Discussion of the Prior Art

Devices adapted to be worn on the forehead such as caps and visors have existed for hundreds of years and for reasons ranging from basic eye shading to status symbols, fashion statements and advertising media. Unfortunately, a number of drawbacks, difficulties and annoying inconveniences have also existed, including the following:

Trying to find a cap or visor that fits correctly;

Trying to find one that is comfortable;

Trying to find one that is durable in use, that can be occasionally cleaned without deformation or damage; and Trying to find one that has all of the desired characteristics such as color, design, and the correct athletic team symbols or other insignia.

The aforementioned inconveniences of the prior art are uniquely overcome by the cap assembly of the present invention. The cap assembly is readily adjustable to several different sizes. Because of the novel design of the apparatus, the visor portion can be quickly and easily disassembled from the crown portion to permit machine washing of the crown portion, thereby avoiding damage to the visor portion. Additionally, different crown portions can be used with different bill portions which comprise the cap assembly to permit desired color variation and coordination. Further, the assembly includes an assortment of differently colored, shaped and styled accessories such as emblems and insignias which can be readily, detachably interconnected with the visor and crown portions of the device so that the wearer can identify with various athletic teams and organizations.

SUMMARY OF THE INVENTION

An object of the present invention is to provide an adjustable, disassembling cap with interchangeable accessories such as visors, emblems, insignias and the like which can be detachably interconnected to form sturdy long wearing caps varying in color and insignia combinations. The interchangeability of the accessories offers people from all walks of life the creative freedom to design a cap with any combination of accessories that will satisfy their particular needs.

Another object of the invention is to provide a cap assembly of the aforementioned character in which the visor portion can be readily removed from the crown portion to permit machine washing of the crown portion.

Still another object of the invention is to provide a cap assembly of the class described in which the various components which make up the cap can be easily assembled and disassembled numerous times without degradation.

A further object of the invention is to provide a cap assembly in which the various components are inexpensive to manufacture in large volume.

DESCRIPTION OF THE INVENTION

Figure 1:
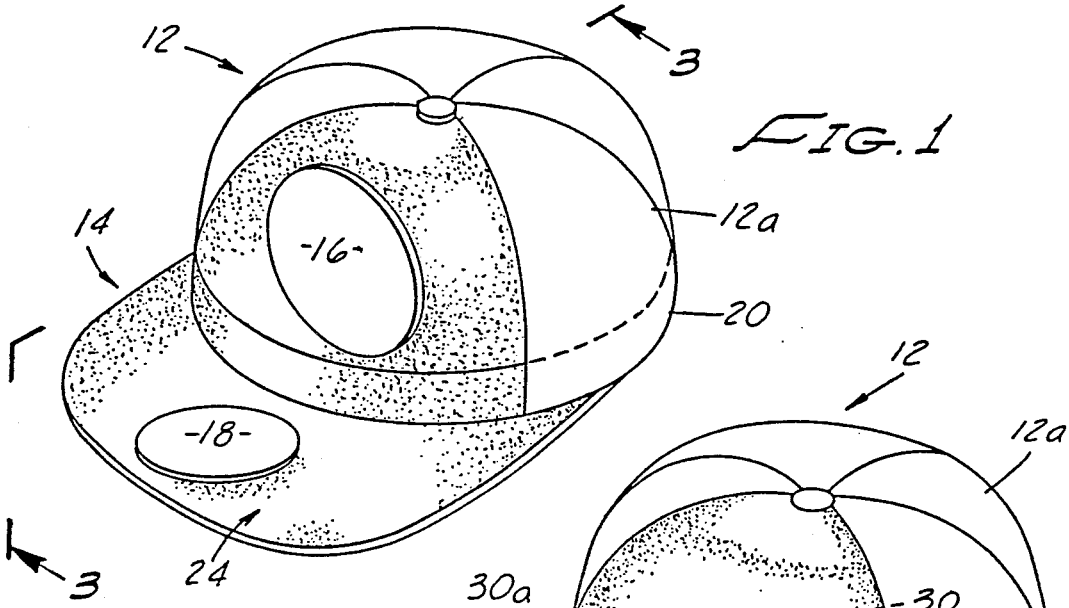
FIG. 1 is a generally perspective view of the cap assembly of the present invention.
Figure 2:
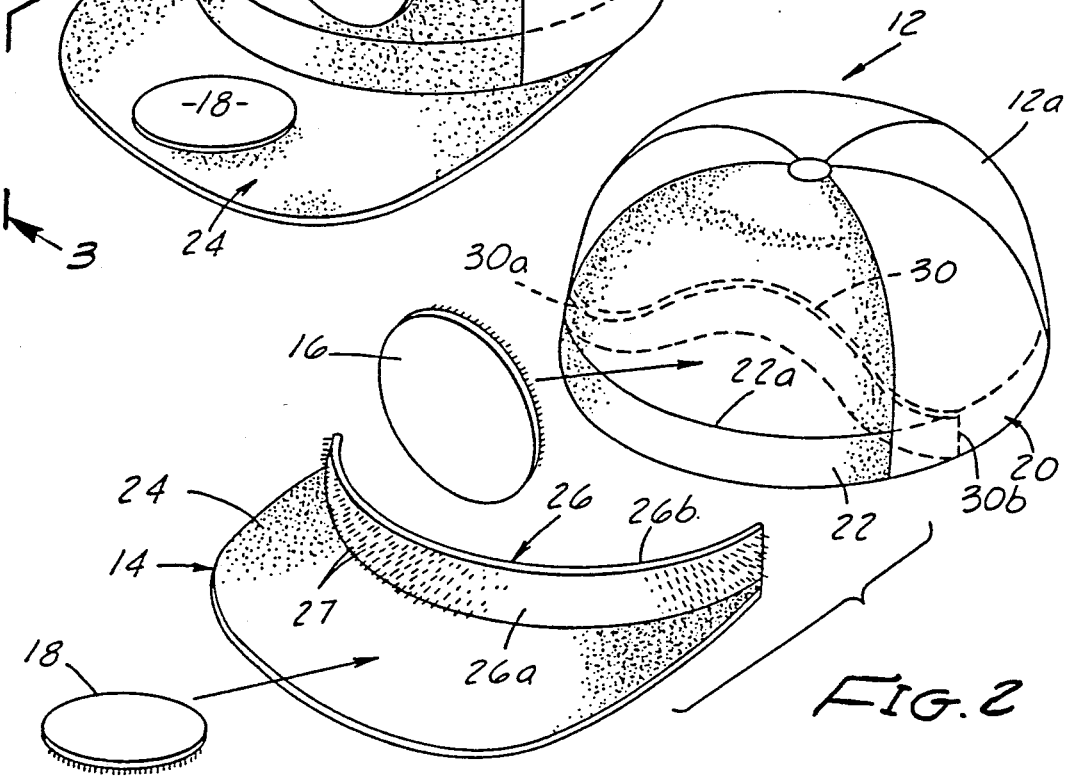
FIG. 2 is an exploded perspective view similar to FIG. 1, but showing the component parts of the apparatus in a disassembled configuration.

Referring to the drawings and particularly to FIGS. 1 and 2, the visored cap apparatus of the present invention comprises a crown assembly 12 and a visor assembly 14 which is detachably interconnected with crown assembly 12. In FIG. 1 the crown assembly and visor assembly are shown as they appear when interconnected. In FIG. 2 the visor assembly is shown detached from the crown assembly 12. The apparatus of the present form of the invention also includes first and second emblem patches 16 and 18 which are detachably affixed to the crown and visor portions respectively in a manner presently to be described.

Figure 3:
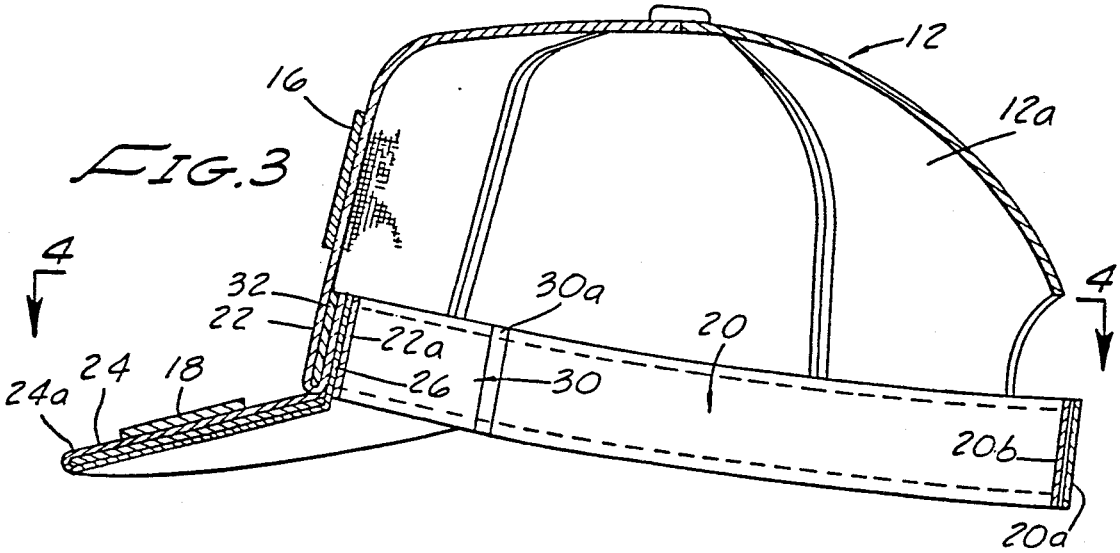
FIG. 3 is a cross sectional view taken along Lines 3—3 of FIG. 1.
Figure 4:
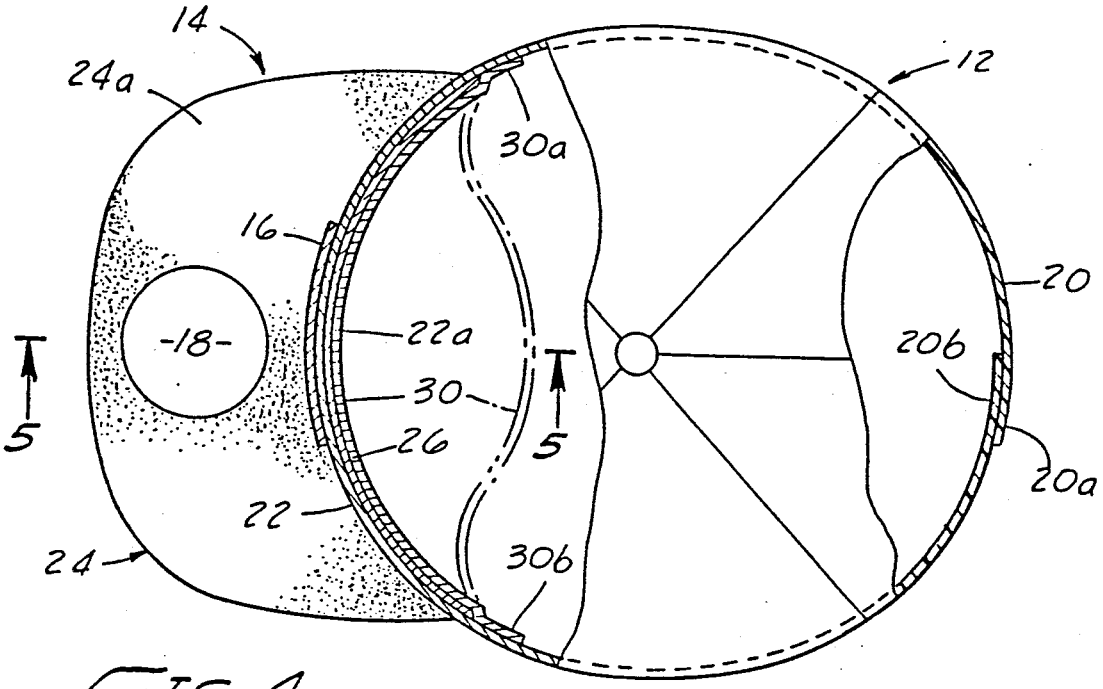
FIG. 4 is a cross sectional view taken along Lines 4—4 of FIG. 3.
Figure 5:
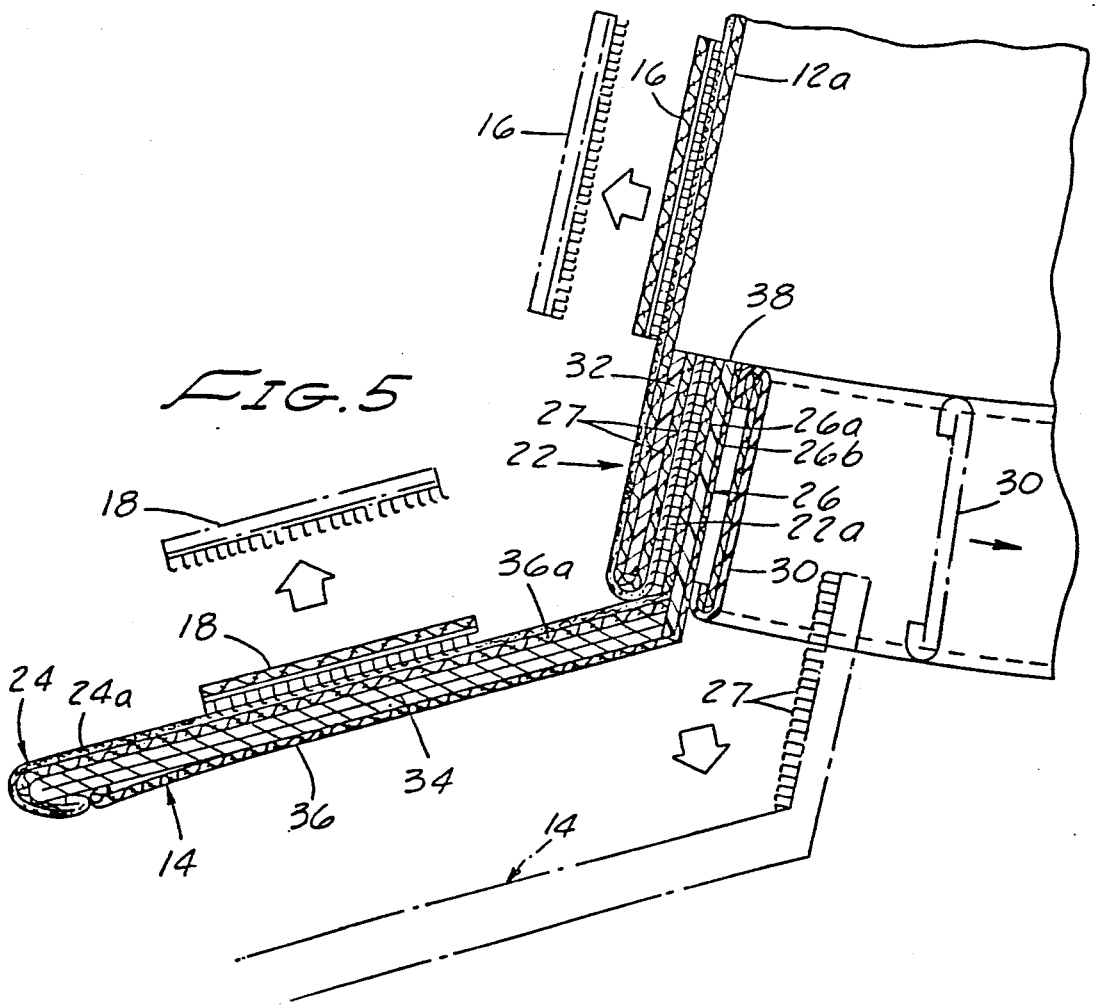
FIG. 5 is an enlarged cross sectional view taken along Lines 5—5 of FIG. 4.

Referring also to FIGS. 3, 4 and 5 the head covering portion **12*a* of the crown assembly 12 includes a circumferentially extending band portion 20 having an arcuate segment 22 the rear surface 22*a*** of which is provided with a multiplicity of small first engagement members to which a multiplicity of second engagement members, such as those found on material sold under the trademark VELCRO, can be releasably interlocked.

The visor assembly 14 includes an eye shade portion 24 and an upstanding generally arcuate shaped portion 26. Portion 26 has first and second, or front and rear surfaces 26*a* and 26*b*. Provided on first surface 26*a* is a multiplicity of the previously mentioned small second engagement members 27 (FIGS. 2 and 5) which may be of a hook shaped character such as found on material sold under the trademark VELCRO.

As best seen by referring to FIG. 2, the crown assembly of the invention also includes an internally disposed, flexible guide band 30 having first and second ends 30*a* and 30*b* which are affixed to band 20 at circumferentially spaced locations proximate the ends of segment 22. Guide band 30 guides the positioning of the visor assembly and is movable from a first retracted position as shown in the dotted lines in FIG. 2 to a second extended position as shown in FIG. 5. As indicated in FIG. 5, the crown assembly of the invention further includes a generally arcuate shaped stiffening band 32 which is carried by the head covering portion 12*a* of crown assembly 12 intermediate a lower circumferentially extending fold of the cloth material which forms the outer covering of portion 12*a* and extends between the first and second ends of guide band 30.

Turning now to FIG. 4, it can be seen that the circumferentially extending band 20 of the head covering portion has first and second overlapping end portions 20*a* and 20*b*. End portions 20*a* and 20*b* comprise the band adjusting means of this form of the invention and each end portion is provided with a multiplicity of small engagement members which interlock to hold portions 20*a* and 20*b* in a predetermined adjustable overlapping position. In this way the diameter of the band 20 can be readily adjusted to fit the wearer's head size.

In the preferred form of the invention, the head covering portion of the device is constructed of a velvet material of the character sold under the trademark TEMPO IRON. The outer surface of this material provides the multiplicity of previously identified small first engagement members which may comprise multiplicity of small loops to which the hook-like members of the VELCRO material will releasably interlock. Similarly, at least the upper surface 24*a* of the visor assembly is covered with a velvet material sold under the trademark TEMPO IRON.

As illustrated in FIG. 5, the visor assembly of the present form of the invention is provided with a cardboard core 34 over which a cloth material 36 is affixed. Superimposed over the upper layer 36*a* of cloth the material 36 is the previously mentioned TEMPO IRON velvet material 24*a*. The upstanding portion 26 of the visor assembly also includes a rigid plastic or cardboard core 38 over which the cloth material 36 is suitably folded. Provided on the front face of the upstanding portion 26 is a VELCRO or like material having the multiplicity of engagement members 27 (FIGS. 2 and 5).

Considering again the head covering portion of the crown assembly, it is to be observed from FIGS. 2 and 5 that the TEMPO IRON velvet material provides the outer surface of the head covering portion and presents a front surface having a plurality of first engagement members adapted to be releasably interconnected with the multiplicity of hook-like members 26*a* such as provided on VELCRO or like material.

The previously identified emblems or insignia members 16 and 18 are preferably backed with a VELCRO-like material having a multiplicity of second engagement means for detachable engagement with the multiplicity of loops provided on the TEMPO IRON velvet material covering the upper surface of the visor portion and the head covering portion of the device. With this construction, the emblems 16 and 18 can be removably affixed as desired to the front surface of the head covering portion and the upper surface of the visor portion in the manner illustrated in FIGS. 2 and 5.

In using the apparatus of the invention, the wearer can select the desired combination from the available designs of visor and crown assemblies and insignia members which make up the cap assemblage. As a first step in assembling the cap, the guide band 30 of the selected crown assembly is moved into the retracted position shown in FIG. 2. The upstanding portion 26 of the selected visor assembly is then inserted between the rear surface of band 20 and the front surface of the guide band 30. The guide band is then moved into the extended position and pressed against upstanding segment 26. This causes the second engagement members 27 to lockably engage the first engagement members provided on the velvet material which has been folded over the stiffening band 32 (FIG. 5). With this arrangement, the selected visor assembly will be maintained securely in place. For added comfort a sponge-like material can be affixed to the rear surface of guide band 30.

Following assembly of the visor and crown assemblies, the selected emblems 16 and 18 can be releasably affixed to the assembled crown and visor in the manner illustrated in FIGS. 2 and 5.

Figure 6:
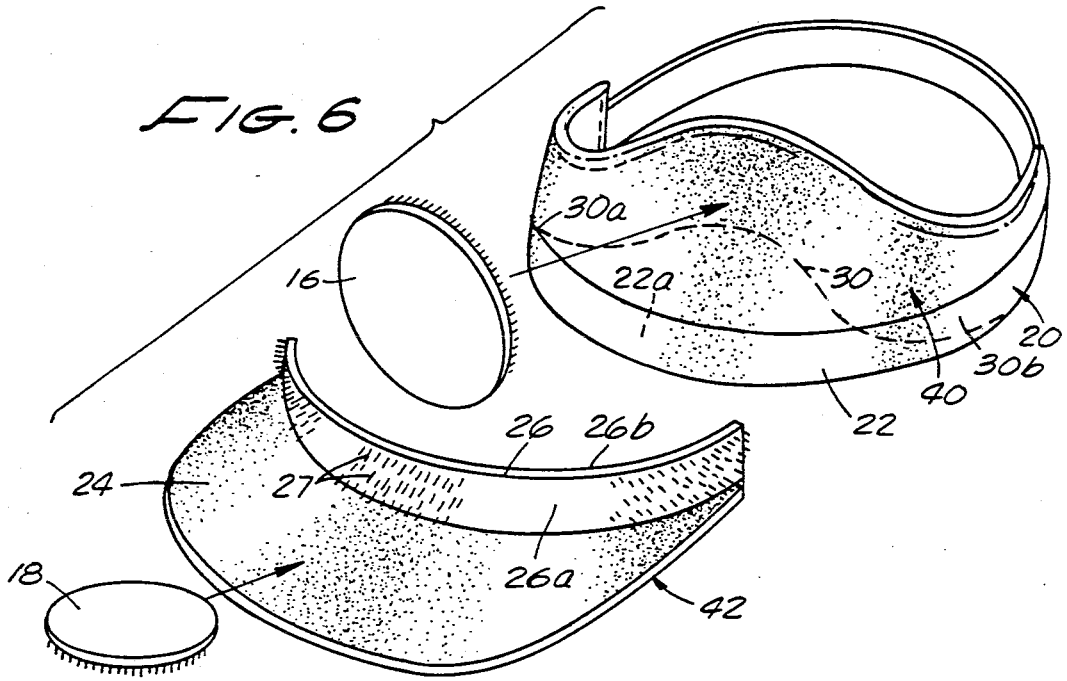
FIG. 6 is a generally perspective, exploded view, similar to FIG. 2, but illustrating another form of the cap assembly of the invention.

Referring to FIG. 6 of the drawings, another form of the cap apparatus of the present invention is thereshown. This form of the invention is similar to the form earlier described and like numbers are used to identify like elements. In this embodiment of the invention, the cap apparatus comprises a headband assembly 40 and a visor assembly 42 which is detachably interconnected with headband assembly 40. The apparatus of this alternate form of the invention is somewhat similar to that illustrated in FIG. 2, save that the visor assembly 42 is removably attached to a modified crown assembly 40, the head covering portion of which has been eliminated. This type of cap is popular for use when it is preferable to have the top of the head uncovered. The apparatus of this alternate form of the invention also includes first and second emblem patches 16 and 18 of the character previously described which are detachably affixed to the headband and visor portions respectively in the manner previously discussed.

As in the earlier described form of the invention, the headband assembly 40 includes a circumferentially extending band portion 20 having an arcuate segment 22, the rear surface 22*a* of which is provided with a multiplicity of small first engagement members to which a multiplicity of second engagement members, such as those found on material sold under the trademark VELCRO, can be releasably interlocked. The visor assembly 42 includes an eye shade portion 24 and an upstanding generally arcuate shaped portion 26. Portion 26 has first and second, or front and rear surfaces 26*a* and 26*b*. Provided on first surface 26*a* is a multiplicity of the previously mentioned small second engagement members 27 which may be of a hook shaped character such as found on material sold under the trademark VELCRO.

As in the form of the invention shown in FIG. 2, the headband assembly 40 also includes an internally disposed, flexible guide band 30 having first and second ends 30*a* and 30*b* which are affixed to band 20 at circumferentially spaced locations proximate the ends of segment 22. Guide band 30 guides the positioning of the visor assembly and is movable from a first retracted position as shown in the dotted lines in FIGS. 2 and 6 to a second extended position as shown in FIG. 5. The headband assembly of the invention further includes a generally arcuate shaped stiffening band 32 such as is shown in FIG. 5. The headband assembly 40 and the visor assembly 42 are connected and disconnected in the same manner as in the previously described form of the invention.

Figure 8:
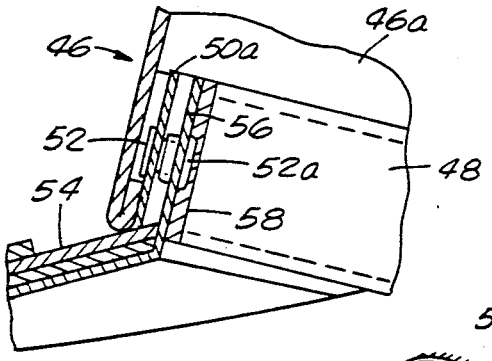
FIG. 8 is an enlarged, fragmentary cross sectional view, further illustrating the interconnecting means of FIG. 7.
Figure 7:
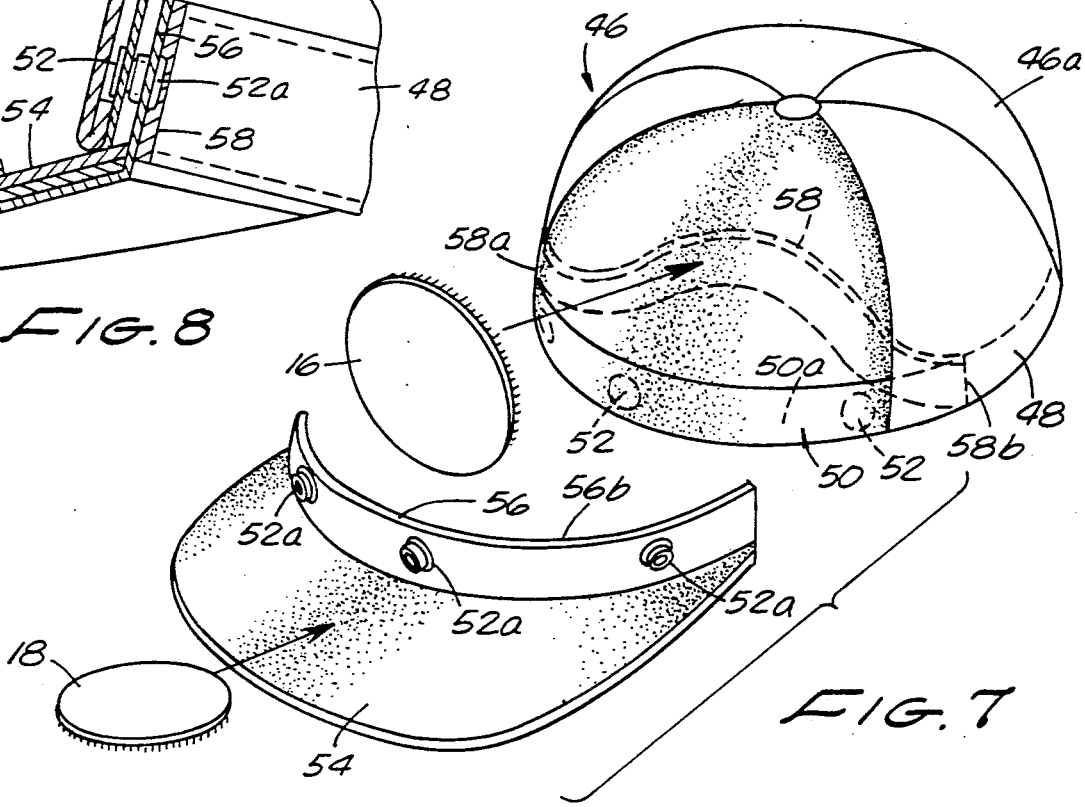
FIG. 7 is a generally perspective, exploded view, similar to FIG. 2, but illustrating a cap assembly embodying a different means for interconnecting the crown assembly and visor assembly.

Turning now to FIGS. 7 and 8, the visored cap apparatus of this third form of the invention comprises a crown assembly 46 and a visor assembly 48 which is detachably interconnected with crown assembly 46. In FIG. 7, the visor assembly is shown detached from the crown assembly 46. The apparatus of this alternate form of the invention is similar in many respects to the embodiment of the invention shown in FIGS. 1 through 5 and like numbers ar used to identify like components. However, this latter form of the invention embodies different means for removably interconnecting the cap and visor assembly. Like the earlier described embodiments of the invention this form of the invention also includes first and second emblem patches 16 and 18 which are detachably affixed to the crown and visor portions respectively in a manner presently to be described.

Referring also to FIG. 8 the head covering portion 46*a* of the crown assembly 46 includes a circumferentially extending band portion 48 having a arcuate segment 50 a surface 50*a* of which is provided with a plurality of snap or pop type engagement members 52 to which a plurality of cooperating snap or pop type engagement members 52*a* can be releasably interconnected.

The visor assembly 48 includes an eye shade portion 54 and an upstanding generally arcuate shaped portion 56. Portion 56 has a front surface 56*a* to which the previously mentioned male snap type engagement members 52*a* are secured.

As best seen by referring to FIG. 7, the crown assembly of this form of the invention also includes an internally disposed, flexible guide band 58 having first and second ends 58*a* and 58*b* which are affixed to band 48 at circumferentially spaced locations proximate the ends of segment 50. Guide band 5 guides the positioning of the visor assembly and is movable from a first retracted position as shown in the dotted lines in FIG. 7 to a second extended position.

In the preferred form of the invention, the head covering portion and the upper covering of the visor are constructed of a velvet material of the character sold under the trademark TEMPO IRON. The outer surface of this material provides the multiplicity of previously identified small first engagement members which may comprise a multiplicity of small loops to which the hook-like members of the VELCR material will releasably interlock.

The previously identified emblems or insignia members 16 and 18 are preferably backed with a VELCRO-like material having a multiplicity of second engagement means for detachable engagement with the multiplicity of loops provided on the TEMPO IRON velvet material covering the upper surface of the visor portion and the head covering portion of the device. With this construction, the emblems 16 and 18 can be removably affixed as desired to the front surface of the head covering portion and the upper surface of the visor portion in the manner illustrated in FIGS. 2 and 5.

In using the apparatus of this form of the invention, the wearer can select the desired combination from the available designs of visor and crown assemblies and insignia members which make up the cap assemblage. As a first step in assembling the cap, the guide band 58 of the selected crown assembly is moved into the retracted position shown in FIG. 7. The upstanding portion 56 of the selected visor assembly is the inserted between the rear surface of segment 50 and the front surface of the guide band 58. The guide band is then moved into the forward position and pressed against upstanding segment 56. This causes the snap type engagement members 52 and 52*a* to lockably engage. With this arrangement, the selected visor assembly will be maintained securely in place.

Figure 9:
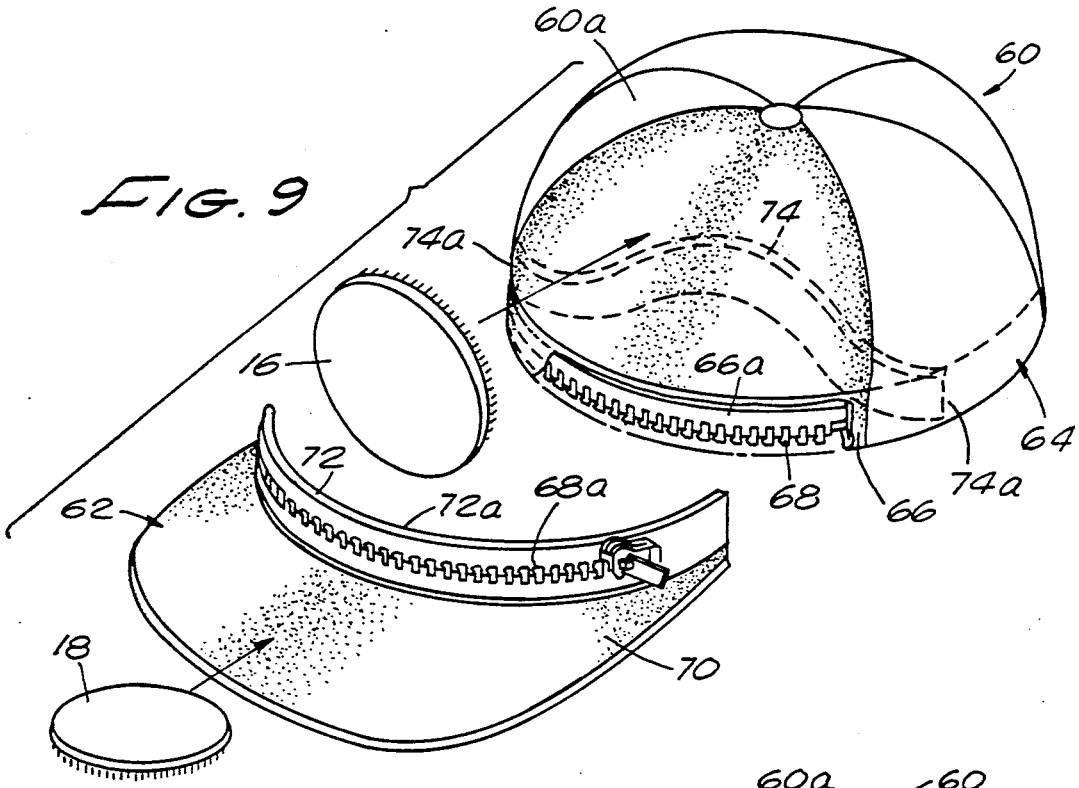
FIG. 9 is a generally perspective, exploded view similar to FIG. 2, but illustrating a cap assembly embodying still a different means for interconnecting the crown assembly and the visor assembly.
Figure 10:
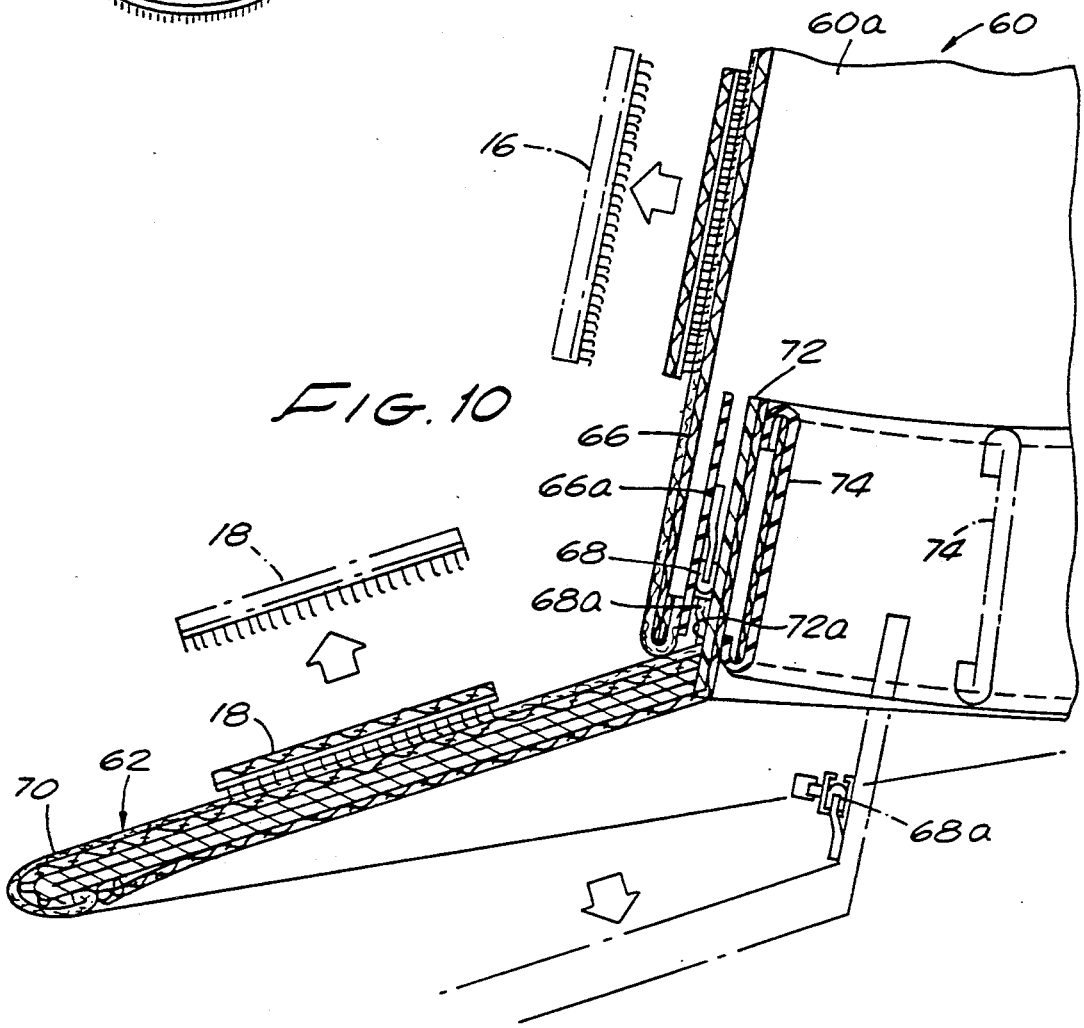
FIG. 10 is a greatly enlarged fragmentary view, further illustrating the interconnecting means of FIG. 9.

Referring to FIGS. 9 and 10, the visored cap apparatus of yet another form of the invention is thereshown. The apparatus of this fourth form of the invention comprises a crown assembly 60 and a visor assembly 62 which is detachably interconnected with crown assembly 60. In FIG. 9, the visor assembly is shown detached from the crown assembly 60. The apparatus of this alternate form of the invention is similar in many respects to the embodiment of the invention shown in FIGS. 1 through 5. However, this latter form of the invention also embodies different means for removably interconnecting the cap and visor assembly. Like the earlier described embodiments of the invention this form of the invention also includes first and second emblem patches 16 and 18 which ar detachably affixed to the crown and visor portions respectively.

Referring also to FIG. 9, the head covering portion 60*a* of the crown assembly 60 includes a circumferentially extending band portion 64 having an arcuate segment 66 the surface 66*a* of which is provided with zipper type engagement members 68 to which a plurality of mating zipper type engagement members 68*a* can be releasably interconnected.

The visor assembly 62 includes an eye shade portion 70 and an upstanding generally arcuate shaped portion 72. Portion 72 has a front surface 72*a* to which the previously mentioned mating zipper type engagement members 68*a* are secured.

As best seen by referring to FIG. 9, the crown assembly of this form of the invention also includes an internally disposed, flexible guide band 74 having first and second ends 74*a* and 74*b* which are affixed to band 64 at circumferentially spaced locations proximate the ends of segment 66. Guide band 74 guides the positioning of the visor assembly and is movable from a first retracted position as shown in the dotted lines in FIG. 9 to a second extended position.

Preferably the head covering portion and the upper covering of the visor are constructed of a velvet material of the character sold under the trademark TEMPO IRON. The outer surface of this material provides the multiplicity of previously identified small first engagement members which may comprise a multiplicity of small loops to which the hook-like members of the VELCRO material will releasably interlock.

The previously identified emblems or insignia members 16 and 18 are preferably backed with a VELCRO-like material having a multiplicity of second engagement means for detachable engagement with the multiplicity of loops provided on the TEMPO IRON velvet material covering the upper surface of the visor portion and the head covering portion of the device. With this construction, the emblems 16 and 18 can be removably affixed as desired to the front surface of the head covering portion and the upper surface of the visor portion in the manner illustrated in FIGS. 2 and 5.

In using the apparatus of the invention, the wearer can select the desired combination from the available designs of visor and crown assemblies and insignia members which make up the cap assemblage. As a first step in assembling the cap, the guide band 74 of the selected crown assembly is moved into the retracted position shown in phantom in FIGS. 9 and 10. The upstanding portion of the selected visor assembly is then inserted between the rear surface of band 64 and the front surface of the guide band 74. The guide band is then moved into the forward position causing the zipper type engagement members to move into a position wherein they can be lockably engaged. With this arrangement, the selected visor assembly will be maintained securely in place.

Figure 11:
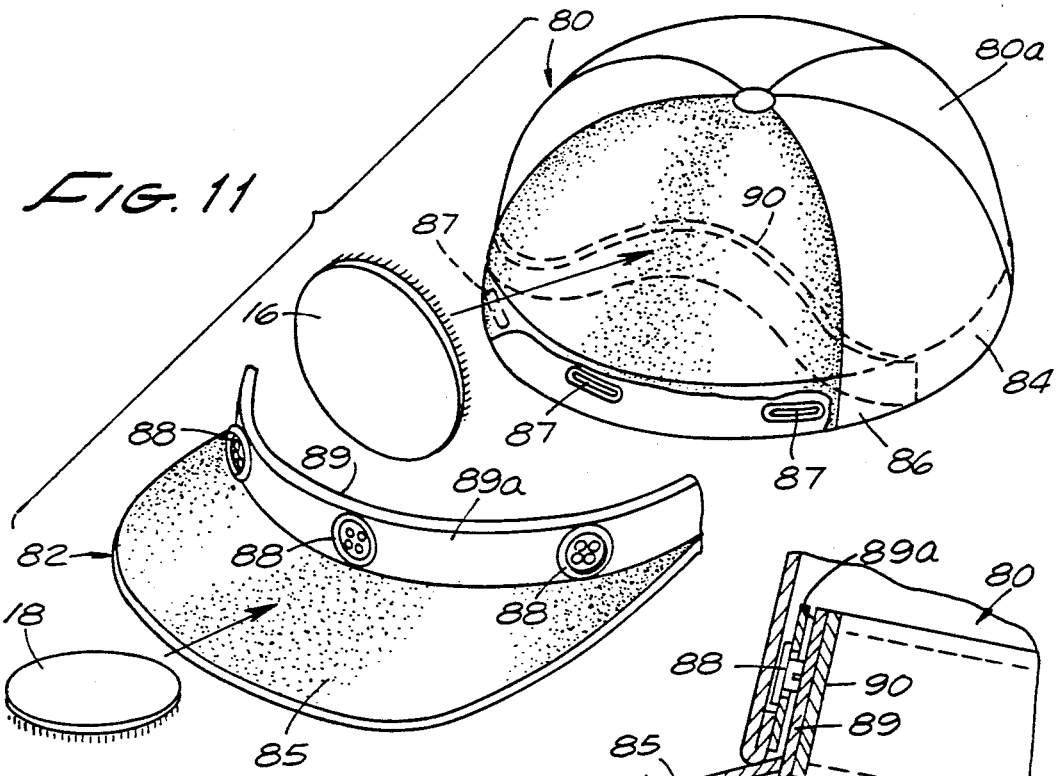
FIG. 11 is a generally perspective, exploded view similar to FIG. 2, but illustrating a cap assembly embodying a button arrangement for interconnecting the crown assembly and the visor assembly.
Figure 12:
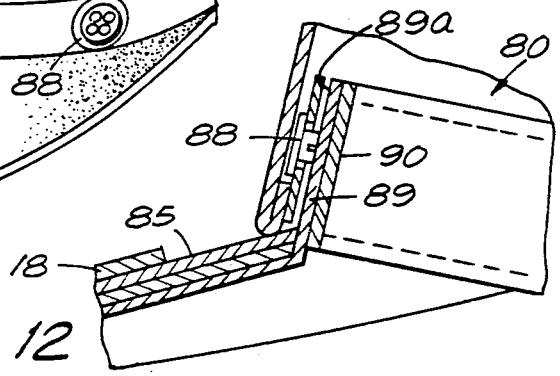
FIG. 12 is an enlarged fragmentary view further illustrating the interconnecting means of FIG. 11.

Turning to FIGS. 11 and 12, the visored cap apparatus of a fifth form of the invention is thereshown. In this form, the apparatus comprises a crown assembly 80 and a visor assembly 82 which is detachably interconnected with crown assembly 80. In FIG. 11, the visor assembly is shown detached from the crown assembly 80. The apparatus of this alternate form of the invention is similar in many respects to the embodiment of the invention shown in FIGS. 1 through 5. However, this latter form of the invention embodies still a different means for removably interconnecting the cap and visor assembly. Like the earlier described embodiments of the invention, this form of the invention also includes first and second emblem patches 16 and 18 which are detachably affixed to the crown and visor portions respectively in a manner presently to be described.

Referring also to FIG. 11 the head covering portion 80*a* of the crown assembly 80 includes a circumferentially extending band portion 84 having an arcuate segment 86 which is provided with a plurality of buttonholes or apertures 87 adapted to receive a plurality of buttons 88.

The visor assembly 82 includes an eye shade portion 84 and an upstanding generally arcuate shaped portion 89. Portion 89 has a front surface 89*a* to which the previously mentioned buttons 88 are secured.

As best seen by referring to FIG. 11, the crown assembly of this form of the invention also includes an internally disposed, flexible guide band 90 which is movable from a first retracted position as shown in the dotted lines in FIG. 11 to a second extended position.

Once again, the head covering portion and the upper covering of the visor are constructed of a velvet material of the character sold under the trademark TEMPO IRON. The previously identified emblems or insignia members 16 and 18 are preferably backed with a VELCRO-like material having a multiplicity of second engagement means for detachable engagement with the multiplicity of loops provided on the TEMPO IRON velvet material covering the upper surface of the visor portion and the head covering portion of the device. With this construction, the emblems 16 and 18 can be removably affixed as desired to the front surface of the head covering portion and the upper surface of the visor portion in the manner illustrated.

In using the apparatus of the invention, the wearer can select the desired combination from the available designs of visor and crown assemblies and insignia members which make up the cap assemblage. As a first step in assembling the cap, the guide band of the selected crown assembly is moved into the retracted position shown in FIG. 11. The upstanding portion 89 of the selected visor assembly is then inserted between the rear surface band and the front surface of the guide band. The buttons are then connected within the buttonholes and the guide band is moved into the forward position. With this arrangement, the selected visor assembly will be maintained securely in place.

Figure 14:
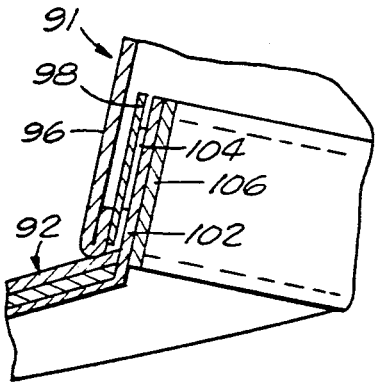
FIG. 14 is an enlarged fragmentary view further illustrating the interconnecting means of FIG. 13.
Figure 13:
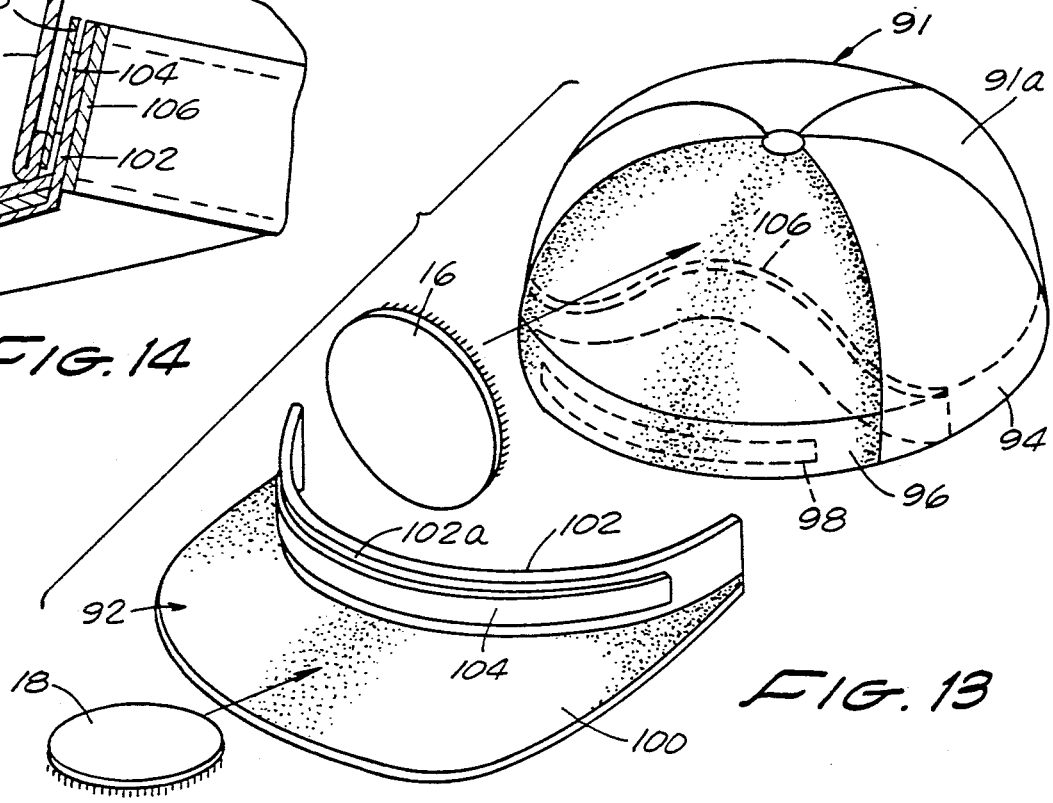
FIG. 13 is a generally perspective, exploded view, similar to FIG. 2, but illustrating yet another form of cap assembly having a different means for interconnecting the crown assembly and the visor assembly.

Referring to FIGS. 13 and 14, the visored cap apparatus of a sixth form of the invention is thereshown. In this form, the apparatus comprises a crown assembly 91 and a visor assembly 92 which is detachably interconnected with crown assembly 91. In FIG. 13, the visor assembly is shown detached from the crown assembly 91. The apparatus of this alternate form of the invention is similar in many respects to the embodiment of the invention shown in FIGS. through 5. However, this latter form of the invention embodies yet a different means for removably interconnecting the cap and visor assembly. Like the earlier described embodiments of the invention this form of the invention also includes first and second emblem patches 16 and 18 which are detachably affixed to the crown and visor portions respectively in a manner presently to be described.

Referring also to FIG. 13, the head covering portion 91*a* of the crown assembly 91 includes a circumferentially extending band portion 94 having an arcuate segment 96 which is provided with a strip of adhesive 98.

The visor assembly 92 includes an eye shade portion 100 and an upstanding generally arcuate shaped portion 102. Portion 102 has a front surface 102*a* to which a second strip of adhesive 104 is secured.

As best seen by referring to FIG. 13, the crown assembly of this form of the invention also includes an internally disposed, flexible guide band 106 which is movable from a first retracted position as shown in the dotted lines in FIG. 13 to a second extended position.

Once again, the head covering portion and the upper covering of the visor are constructed of a velvet material of the character sold under the trademark TEMPO IRON. The previously identified emblems or insignia members 16 and 18 are preferably backed with a VELCRO-like material having a multiplicity of second engagement means for detachable engagement with the multiplicity of loops provided on the TEMPO IRON velvet material covering the upper surface of the visor portion and the head covering portion of the device. With this construction, the emblems 16 and 18 can be removably affixed as desired to the front surface of the head covering portion and the upper surface of the visor portion in the manner illustrated.

In using the apparatus of the invention, the wearer can select the desired combination from the available designs of visor and crown assemblies and insignia members which make up the cap assemblage. As a first step in assembling the cap, the guide band of the selected crown assembly is moved into the retracted position shown in FIG. 13. The upstanding portion of the selected visor assembly is then inserted between the rear surface of segment 96 and the front surface of guide band 106. The guide band is then moved into the forward position to bring the cooperating strips of adhesive 98 and 104 into releasable engagement. With this arrangement, the selected visor assembly will be maintained securely in place.

Having no described the invention in detail in accordance with the requirements of the patent statutes, those skilled in this art will have no difficulty in making changes and modifications in the individual parts or their relative assembly in order to meet the specific requirements or conditions. Such changes and modifications may be made without departing from the scope and spirit of the invention as set forth in the following claims.

I claim:

1. A visored cap apparatus comprising:

(a) a crown assembly including:

(i) a headband assembly having a circumferentially extending band, said band including an exterior arcuate portion provided with a multiplicity of small first engagement members; and (ii) an interior flexible guide band having first and second ends affixed to said circumferentially extending band, at circumferentially spaced location, said guide band being movable between a first retracted position and a second extended position; and (iii) a generally arcuate shaped stiffening band carried by said headband assembly intermediate said first and second ends of said guide band; and (b) a visor assembly including an eye shade portion and an upstanding generally arcuate shaped portion, said arcuate shaped portion having first and second surfaces, said first surface having a multiplicity of small second engagement members for locking engagement with said first engagement members provided on said arcuate portion of said band of said headband assembly.

2. A visored cap apparatus as defined in claim 1 in which said headband assembly further includes a front surface portion provided with a multiplicity of small first engagement members and in which said crown assembly further includes an emblem having a surface provided with a multiplicity of small second engagement members for detachable engagement with said first engagement members of said front surface portion.

3. A visored cap apparatus as defined in claim 2 in which said visor assembly further includes an emblem having a surface provided with a multiplicity of small second engagement members and in which said eye shade portion further includes an upper surface portion provided with a multiplicity of small first engagement members for detachable engagement with said second engagement members of said emblem.

4. A visored cap apparatus comprising:

(a) a crown assembly including:

(i) a head covering portion having a circumferentially extending band, said band having an arcuate portion provided with first engagement means; and (ii) an interior flexible guide band having first and second ends affixed to said circumferentially extending band, at circumferentially spaced location, said guide band being movable between a first retracted position and a second extended position; and (iii) a generally arcuate shaped stiffening band carried by said head covering portion intermediate said first and second ends of said guide band; and (b) a visor assembly including an eye shade portion and an upstanding generally arcuate shaped portion, said arcuate shaped portion having first and second surfaces, said first surface having second engagement means for engagement with said first engagement means provided on said arcuate portion of said band of said head covering portion.

5. A visored cap apparatus as defined in claim 4 in which said head covering portion further includes a front surface portion provided with a multiplicity of small first engagement members and in which said crown assembly further includes an emblem having a surface provided with a multiplicity of small second engagement members for detachable engagement with said first engagement members of said front surface portion.

6. A visored cap apparatus as defined in claim 4 in which said visor assembly further includes an emblem having a surface provided with a multiplicity of small second engagement members and in which said eye shade portion further includes an upper surface portion provided with a multiplicity of small first engagement members for detachable engagement with said second engagement members of said emblem.

7. A visored cap apparatus as defined in claim 4 in which said first engagement means comprises first snap connectors and in which said second engagement means comprises second snap connectors releasably interconnectable with said first snap connectors.

8. A visored cap apparatus as defined in claim 4 in which said first engagement means comprises first zipper type engagement members and in which said second engagement means comprises second zipper type engagement members releasably interconnectable with said first zipper engagement members.

9. A visored cap apparatus as defined in claim 4 in which said first engagement means comprises a first strip of adhesive and in which said second engagement means comprises a second strip of adhesive releasably interconnectable with said first strip of adhesive.

10. A visored cap apparatus as defined in claim 4 in which said first engagement means comprises a plurality of buttonholes and in which said second engagement means comprises a plurality of buttons removably receivable within said buttonholes.

11. A visored cap assemblage comprising:

(a) a crown assembly including:

(i) a head covering portion having a front surface portion provided with a multiplicity of small first engagement members and a circumferentially extending band, said band including an arcuate portion provided with first engagement means;

(ii) an interior flexible guide band having first and second ends affixed to said circumferentially extending band at circumferentially spaced locations said guide band being movable between a first retracted position and a second extended position;

(iii) a generally arcuate shaped stiffening band carried by said head covering portion intermediate said first and second ends of said guide band; and (iv) at least two emblems each having a surface provided with a multiplicity of small second engagement members for detachable engagement with said first engagement members of said front surface portion;

(b) at least two visor assemblies each including an eye shade portion having an upper surface provided with a multiplicity of small first engagement members and an upstanding generally arcuate shaped portion, said arcuate shaped portion having second engagement means for releasable interengagement with said first engagement means provided on said arcuate portion of said band of said head covering portion, said visor assembly further including at least two emblems each having a surface provided with a multiplicity of small second engagement members for locking engagement with said first engagement members provided on said upper surface of said eye shade portion.

* * * * *